US005201944A

United States Patent [19]

Nakata et al.

[11] Patent Number: 5,201,944

[45] Date of Patent: Apr. 13, 1993

[54] SIZE COMPOSITION FOR PAPERMAKING

[75] Inventors: Tomohiko Nakata, Kakogawa; Hirofumi Aoki, Himeji; Shoichi Yano, Kakogawa; Yoshihide Ishikawa, Himeji; Masao Hamada, Kakogawa, all of Japan

[73] Assignee: Harima Chemicals, Inc., Hyogo, Japan

[21] Appl. No.: 707,791

[22] Filed: May 30, 1991

[30] Foreign Application Priority Data

Apr. 2, 1991 [JP] Japan ..... 3-98231

[51] Int. Cl.[5] ..... C09D 189/00

[52] U.S. Cl. ..... 106/144; 106/218; 106/238; 162/174; 162/180

[58] Field of Search ..... 106/144, 238, 218; 162/174, 180

[56] References Cited

U.S. PATENT DOCUMENTS 3,906,142 9/1975 Dowthwaite et al. ..... 106/144

4,540,635 9/1985 Ronge et al. ..... 106/238

4,983,257 1/1991 Schultz et al. ..... 106/238

FOREIGN PATENT DOCUMENTS 57-070158 4/1982 Japan ..... 106/238

*Primary Examiner*—David Brunsman

*Attorney, Agent, or Firm*—Birch, Stewart, Kolasch & Birch

[57] ABSTRACT

The present invention relates to a size composition which shows an excellent sizing effect in neutral to weakly acidic papermaking.

Alkanol tertiary amine and fortified rosin, incorporated in the size composition of the present invention, even when prepared as dispersions using a dispersant, are extremely poor in sizing performance in the neutral pH range, whereas the size composition obtained by mixing these components in a ratio according to the present invention and dispersing them using a surfactant specified by the present invention offers an excellent sizing in the neutral to weakly acidic pH range.

7 Claims, No Drawings

SIZE COMPOSITION FOR PAPERMAKING

BACKGROUND OF THE INVENTION

The present invention relates to a size for a papermaking, more specifically to an internal size which works very well in papermaking under neutral to weakly acidic conditions.

DESCRIPTION OF RELATED ART

Traditionally, rosin-based sizes have been widely used in papermaking. It has long been known that the sizing effect of rosin-based sizes is attributed to the retention-improving and water-repelling action produced by utilizing alminium sulfate added as a sizing aid. Moreover alminium sulfate becomes acidic upon dissociation, rosin-based sizes have been used under acidic conditions.

In recent years, however, there has been an increasing trend toward pH neutral papermaking due to the poor permanence of acidic papers, and the increased use of calcium carbonate content in papers as a coat color pigment, for example in printing papers.

Conventional rosin emulsion sizes consist mainly of so-called fortified rosins, i.e., rosins modified with $\alpha$, $\beta$-unsaturated dibasic acids, and an anionic surfactant. The sizing effect of these rosins is lowered significantly when the pH exceeds 6.5 in the papermaking systems described above. For this reason, it is necessary to use an increased amount of size to obtain the desired degree of sizing, but this practice not only leads to higher cost due to the use of the excess size, but also poses operational problems such as foaming and pitch formation in such papermaking systems and adversely affects the quality of the finished papers.

Taking note of this situation, sizes based on an alkyl ketene dimer (hereinafter called AKD) and those based on an alkenyl succinic anhydride (hereinafter called ASA) are commonly used for neutral papermaking, but AKD and ASA are both cellulose-reactive sizes and thus pose problems related to stability. These reactive sizes are often used in a dispersion in the presence of a protective colloid such as a cationic starch, but their dispersions are poor in stability. When incorporated into a papermaking system, their tackiness increases with the collapse of the dispersion, resulting in major problems such as the staining of a papermaking equipment and thus their use demands an improvement.

In parallel to investigations aimed at improving the AKD and ASA sizes described above, the use of rosin-based neutral sizes has been proposed. For example, see Japanese Patent Publication Open to Public Inspection (hereinafter referred to as Japanese Patent O.P.I. Publication) Nos. 250297/1987 (equivalent to U.S. Pat. No. 4,842,691) and 120198/1988 (equivalent to U.S. Pat. No. 4,943,608) and Japanese Patent Examined Publication No. 36629/1990 (equivalent to U.S. Pat. No. 4,540,635).

Rosin-based sizes incorporating various rosin esters have long been known. For example, U.S. Pat. No. 3,044,890 discloses fortified rosin dispersions prepared by esterifying the base rosin with a polyhydric alcohol such as glycerol, propylene glycol or pentaerythritol, and British Patent No. 859789 discloses mixtures of fortified rosin and aminoalcoholesterified rosin. However, none of these patents show a noticeable effect; similarly with the type of rosin ester, the esterification ratio, the method of dispersion and other to pertinent features not even considered thoroughly therein.

The art described in Japanese Patent O.P.I. Publication No. 250297/1987 comprises an aqueous dispersion containing an $\alpha$, $\beta$-unsaturated dibasic acid modified rosin ester of a polyhydric alcohol comprising carbon, hydrogen and oxygen. However, the dispersion does not serve well as a size for neutral paper because its sizing effect is lowered significantly at pH levels above 7 in papermaking.

In contrast to the above-mentioned art of British Patent No. 859789, which uses a mixture of fortified rosin and an alkanolamine ester of a rosin, the art described in Japanese Patent Examined Publication No. 36629/1990 aims at improving the sizing around the neutral pH range by modifying the partial amino alcohol ester of a rosin with $\alpha$, $\beta$-unsaturated dibasic acid. Although the size specified in Japanese Patent Examined Publication No. 36629/1990 offers better sizing around the neutral pH range than does the above-mentioned polyhydric alcohol ester of modified rosin described in Japanese Patent O.P.I. Publication No. 250297/1987, it does not yield a good emulsion nor does offer sufficient sizing around the neutral pH range.

The art described in Japanese Patent O.P.I. Publication No. 120198/1987 comprises a rosin-based emulsion size comprising fortified rosin and a copolymer of alkyl (meth)acrylate ester and/or a styrene compound and alkylaminoalkyl (meth)acrylate ester or alkylaminoalkylamide, but it does not serve well as a size for neutral paper because its sizing quality around the neutral pH range is low.

SUMMARY OF THE INVENTION

The present invention has been developed with an aim of solving the aforementioned problems in the prior art, and provides a good size which is excellent in stability and which quickly exhibits a sizing effect especially in the neutral pH range.

The size composition of the present invention is a rosin-containing size for papermaking characterized in that a surfactant represented by the formula (1) shown below in a ratio of 1 to 10 wt % of the solids in the size and casein in a ratio not exceeding 10 wt % of the solids in the size are added to, and dispersed in, a mixture of an esterification product of rosin and an alkanol tertiary amine, which is produced by adding the alkanol tertiary amine in a ratio of 1.5 to 10 wt % of the total rosin content in the size, and a fortified rosin produced by adding an $\alpha$, $\beta$-unsaturated carbonyl compound in a ratio of 3 to 11 wt % of the total rosin content in the size to reach a solid content of 20 to 60 wt % in the size composition.

$$R-O(CH_2CH_2O)_nOC-\underset{\underset{X}{|}}{CH}-\underset{\underset{Y}{|}}{CH}-COOM \quad (1)$$

In the above formula (1) R represents a $C_{10-24}$ alkylphenyl group or a linear or branched alkyl group; n represents an integer of 6 to 20; X and Y independently represent H or $SO_3M$; M represents sodium, potassium or an ammonium group.

Examples of the rosin used in the present invention include gum rosin, tall oil rosin and wood rosin. Examples of the alkanol tertiary amine include triethanolamine, tripropanolamine, triisopropanolamine, N-isobutyldiethanolamine and N-normal-butyldiethanolamine. Esterification of rosin and alkanol tertiary amine can be carried out by thermally melting the rosin and thereafter drop by drop addition of the alkanol tertiary amine to the molten rosin. An appropriate esterification temperature is between 190° and 230° C.

The modification of rosin with an α, β-unsaturated carbonyl compound can be achieved by a known method. Examples of α, β-unsaturated carbonyl compounds include maleic acid, maleic anhydride, fumaric acid, itaconic acid, itaconic anhydride, citraconic acid, acrylic acid and methacrylic acid.

These rosins may be disproportionated, and may be pre-treated with formaldehyde etc. Additional rosin may be added after reaction within the range allowed by the present invention. It is also possible to add ordinary extenders, such as waxes and various rosin esters other than the rosin ester with alkanol tertiary amine, in ratios up to 10 wt % of the desired composition.

The surfactant represented by the formula (1), a key component of the size composition of the present invention, is obtained by condensing alkylphenol or alcohol and ethylene oxide by a known method and converting the resulting condensate into a halfester of sulfosuccinic acid by a conventional method. Commercially available products of the compound represented by the formula (1) are AEROSOL ® A-103 [with alkylphenol for R in the formula (1)], a product of American Cyanamid Company, and SOFTANOL ® MES-12 [with higher secondary alcohol for R in the formula (1)], a product of Nippon Shokubai Kagaku Kogyo Co., Ltd., both of which can be used as additives for the composition of the present invention.

In emulsion sizes, the sizing effect and size stability are critical factors. Even when a mixture of a rosin esterification product and a rosin fortified with an α,β-unsaturated carbonyl compound is dispersed in casein as such by the ordinary emulsion inversion method to yield a size composition, the resulting size composition is not satisfactory in sizing and stability. The desired effect of the present invention is obtained by adding a surfactant represented by the formula (1) involved in the present invention.

The size composition of the present invention includes the aforementioned rosin reaction product described in British Patent No. 859787, but the dispersion according to the present invention differs from complete saponified sizes in size morphology and sizing effect. In addition, it was found that the dispersion of each of components of the size of the present invention, namely the alkanol tertiary amine ester of rosin and the fortified rosin, is extremely poor in sizing performance near the neutral pH range, while the size obtained by mixing these components in a ratio according to the present invention and dispersing the mixture shows an excellent sizing effect, based on which finding the present invention was developed.

The size composition of the present invention is compositionally different from the α,β-unsaturated dibasic acid modified product of the alkanolamine ester of rosin according to the art described in Japanese Patent Examined Publication No. 36629/1990. Also, problems posed by the casein dispersion disclosed in Examples of Japanese Patent Examined Publication No. 36629/1990, such as insufficient stability and sizing due to extremely great particle size and coloring of the reaction product during modification reaction of the alkanolamine ester of rosin with α,β-unsaturated dibasic acid, can be solved by the size composition of the present invention.

DETAILED DESCRIPTION OF PREFERRED EMBODIMENTS

The present invention is hereinafter described in more detail by means of the following examples of the preferred embodiments. In the description below, "part(s)" indicates "part(s) by weight" unless otherwise stated.

SYNTHESIS OF ROSIN DERIVATIVES

Synthesis Example 1

100 parts of tall oil rosin (acid value 167) was molten by heating at 210° C., and 10 parts of triethanolamine was added drop by drop over a period of 20 minutes (COOH:OH=1:0.68). While continuing dehydration at constant temperature, a reaction was carried out for 5 hours. The resulting resin had an acid value of 63.

Synthesis Example 2

100 parts of tall oil rosin (acid value 167) was molten by heating at 210° C., and 17.6 parts of maleic anhydride was charged in separate additions over a period of 1 hour, and this temperature was kept for 2 hours. The resulting resin had an acid value of 226.

Comparative Synthesis Example 1

100 parts of tall oil rosin (acid value 167) was molten by heating at 210° C., and 9.4 parts of maleic anhydride was charged in separate additions over a period of 20 minutes, followed by a reaction at this temperature for 1 hour. Then, 6 parts of triethanolamine was added drop by drop over a period of 20 minutes. The mixture was heated to 230° C. and kept at this temperature for 3 hours. The resulting resin had an acid value of 148.

Comparative Synthesis Example 2

100 parts of tall oil rosin (acid value 167) was molten by heating at 250° C., and 8 parts of glycerol was added drop by drop over a period of 20 minutes. While continuing dehydration at a constant temperature, a reaction was carried out for 10 hours. Then, the temperature was decreased to 210° C., and 9 parts of maleic anhydride was carefully added gradually. After the completion of the addition of maleic anhydride, the mixture was kept at a constant temperature for 90 minutes. The resulting resin had an acid value of 78.4.

Comparative Synthesis Example 3

100 parts of tall oil rosin (acid value 167) was molten by heating at 210° C., and 6.4 parts of maleic anhydride was charged in separate additions over a period of 1 hour. The mixture was kept at this temperature for 2 hours. The resulting resin had an acid value of 191.

Comparative Synthesis Example 4

100 parts of tall oil rosin (acid value 167) was molten by heating at 200° C., and 5.3 parts of fumaric acid was charged in separate additions over a period of 1 hour. The mixture was kept at this temperature for 2 hours. The resulting resin had an acid value of 205.

PREPARATION OF AQUEOUS DISPERSIONS

Example 1

40 parts of the resin of Synthesis Example 1 and 60 parts of the resin of Synthesis Example 2 were molten at 180° C. and cooled to 130° C. 12 parts (active ingredient 3 parts) of SOFTANOL ® MES-12, as the surfactant, was gradually added to this molten resin with stirring, and then 50 parts of a 10% casein solution (5 parts of casein, 2.6 parts of 25% aqueous ammonia, diluted with water to reach a total quantity of 50 parts) was gradually added drop by drop. 60 parts of hot water at 95° C. was gradually added drop by drop to invert the mixture to an oil-in-water emulsion. Then, after 130 parts of hot water was added, the solution was rapidly cooled to 30° C. The resulting emulsion had a solid content of 31%.

Example 2

50 parts of the resin of Synthesis Example 1 and 50 parts of the resin of Synthesis Example 2 were molten at 180° C. and cooled to 130° C. 12 parts (active ingredient 3 parts) of SOFTANOL® MES-12 was gradually added to this molten resin with stirring, and then 50 parts of a 10% casein solution (5 parts of casein, 1.9 parts of 10% NaOH, diluted with water to reach a total quantity of 50 parts) was gradually added drop by drop. 60 parts of hot water at 95° C. was gradually added drop by drop to invert the mixture to an oil-in-water emulsion. Then, after 130 parts of hot water was added, the solution was rapidly cooled to 30° C. The resulting emulsion had a solid content of 31%.

Example 3

60 parts of the resin of Synthesis Example 1 and 40 parts of the resin of Synthesis Example 2 were molten at 180° C. and cooled to 130° C. 8.8 parts (active ingredient 3 parts) of AEROSOL® A-103 was gradually added to this molten resin with stirring, and then 70 parts of a 10% casein solution (4 parts of casein, 2.0 parts of 25% aqueous ammonia, diluted with water to reach a total quantity of 70 parts) was gradually added drop by drop. 40 parts of hot water at 95° C. was gradually added drop by drop to invert the mixture to an oil-in-water emulsion. Then, after 130 parts of hot water was added, the solution was rapidly cooled to 30° C. The resulting emulsion had a solid content of 31%.

Example 4

60 parts of the resin of Synthesis Example 1, 60 parts of the resin of Synthesis Example 2 and 80 parts of formaldehyde-treated tall oil rosin were dissolved in 200 parts of toluene. 12 parts (active ingredient 3 parts) of SOFTANOL® MES-12, 40 parts of a 10% aqueous solution of casein (4 parts of casein, 1.5 parts of 10% NaOH, diluted with water to reach a total quantity of 40 parts) and 340 parts of ion exchange water were added to this solution, and they were mixed by using a homomixer at 40° C. Subsequently, the dispersion was passed through a piston type high pressure mechanical emulsifier (200 kg/cm$^2$) once to yield a fine dispersion. Then, the toluene and a small amount of water were distilled off under the reduced pressure to yield an aqueous dispersion. The resulting emulsion had a solid content of 35%.

Example 5

140 parts of the resin of Synthesis Example 1 and 60 parts of the resin of Synthesis Example 2 were dissolved in 200 parts of toluene. 24 parts (active ingredient 6 parts) of SOFTANOL® MES-12 and 365 parts of ion exchange water were added to this solution, and they were mixed by using a homomixer at 40° C. Subsequently, the dispersion was passed through a piston type high pressure mechanical emulsifier (200 kg/cm$^2$) once to yield a fine dispersion. Then, the toluene and a small amount of water were distilled off under the reduced pressure to yield an aqueous dispersion. The resulting emulsion had a solid content of 35%.

Comparative Example 1

55 parts of the resin of Synthesis Example 1 and 45 parts of the resin of Synthesis Example 2 were molten at 180° C. and cooled to 130° C. 16 parts (active ingredient 4 parts) of a 25% aqueous solution of sulfate ester ammonium salt of polyoxyethylene nonylphenyl ether was gradually added to this molten resin with stirring, and then 40 parts of a 10% casein solution (4 parts of casein, 1.5 parts of 10% NaOH, diluted with water to reach a total quantity of 40 parts) was gradually added drop by drop. 60 parts of hot water at 95° C. was gradually added drop by drop to invert the mixture to an oil-in-water emulsion. Then, after 130 parts of hot water was added, the solution was rapidly cooled to 30° C. The resulting emulsion had a solid content of 31%.

Comparative Example 2

55 parts of the resin of Synthesis Example 1 and 45 parts of the resin of Synthesis Example 2 were molten at 180° C. 12 parts (active ingredient 3 parts) of a 25% aqueous solution of sodium dodecylbenzenesulfonate was gradually added to this molten resin with stirring, and then 70 parts of a 10% casein solution (7 parts of casein, 1.9 parts of 10% NaOH, diluted with water to reach a total quantity of 70 parts) was gradually added drop by drop. 40 parts of hot water at 95° C. was gradually added drop by drop to invert the mixture to an oil-in-water emulsion. Then, after 130 parts of hot water was added, the solution was rapidly cooled to 30° C. The resulting emulsion had a solid content of 31%.

Comparative Example 3

50 parts of the resin Synthesis Example 1 and 50 parts of the resin of Synthesis Example 2 were molten at 180° C. and cooled to 130° C. 50 parts of a 10% casein solution (5 parts of casein, 2.6 parts of 25% aqueous ammonia, diluted with water to reach a total quantity of 50 parts) was gradually added to this molten resin drop by drop with stirring. 60 parts of hot water at 95° C. was gradually added drop by drop to invert the mixture to an oil-in-water emulsion. Then, 130 parts of hot water was added, and the solution was rapidly cooled to 30° C. The resulting emulsion had a solid content of 31%.

Comparative Example 4

100 parts of the resin of Comparative Synthesis Example 1 was molten at 180° C. and cooled to 130° C. 50 parts of a 10% casein solution (5 parts of casein, 1.9 parts of 10% NaOH, diluted with water to reach a total quantity of 50 parts) was gradually added to this molten resin drop by drop with stirring. 60 parts of hot water at 95° C. was gradually added drop by drop to invert the mixture to an oil-in-water emulsion. Then, after 130 parts of hot water was added, the solution was rapidly cooled to 30° C. The resulting emulsion had a solid content of 31%.

Comparative Example 5

200 parts of the resin of Comparative Synthesis Example 3 was dissolved in 200 parts of toluene. 100 parts (active ingredient 10 parts) of a 10% aqueous solution of sulfate ester ammonium salt of polyoxyethylene distyrylphenyl ether and 300 parts of ion exchange water were added to this solution, and they were mixed by using a homomixer at 40° C. Subsequently, the dispersion was passed through a piston type high pressure mechanical emulsifier (200 kg/cm$^2$) once to yield a fine dispersion. Then, the toluene and a small amount of water were distilled off under the reduced pressure to yield an aqueous dispersion. The resulting emulsion had a solid content of 35%.

Comparative Example 6

200 parts of the resin of Synthesis Example 1 was dissolved in 200 parts of toluene. 40 parts of a 10% casein solution (4 parts of casein, 1.5 parts of 10% NaOH, diluted with water to reach a total quantity of 40 parts) and 340 parts of ion exchange water were added to this solution, and they were mixed by using a homomixer at 40° C. Subsequently, the dispersion was passed through a piston type high pressure mechanical emulsifier (200 kg/cm$^2$) once to yield a fine dispersion. Then, the toluene and a small amount of water were distilled off under reduced pressure to yield an aqueous dispersion. The resulting emulsion had a solid content of 35%.

Comparative Example 7

100 parts of the resin of Synthesis Example 2 was molten at 180° C. and cooled to 130° C. 50 parts of a 10% casein solution (5 parts of casein, 2.6 parts of 20% aqueous ammonia, diluted with water to reach a total quantity of 50 parts) was gradually added to this molten resin drop by drop with stirring. 60 parts of hot water at 95° C. was gradually added drop by drop to invert the mixture to an oil-in-water emulsion. Then, after 130 parts of hot water was added, the solution was rapidly cooled to 30° C. The resulting emulsion had a solid content of 31%.

Comparative Example 8

100 parts of the resin of Comparative Synthesis Example 3 was molten at 180° C. and cooled to 130° C. 50 parts of a 10% casein solution (5 parts of casein, 1.9 parts of 10% NaOH, diluted with water to reach a total quantity of 50 parts) was gradually added to this molten resin drop by drop with stirring. 60 parts of hot water at 95° C. was gradually added drop by drop to invert the mixture to an oil-in-water emulsion. Then, after 130 parts of hot water was added, the solution was rapidly cooled to 30° C. The resulting emulsion had a solid content of 31%.

Comparative Example 9

100 parts of the resin of Comparative Synthesis Example 4 was molten at 180° C. and cooled to 130° C. 20 parts (active ingredient 5 parts) of a 25% aqueous solution of sulfate ester ammonium salt of polyoxyethylene nonylphenyl ether was gradually added to this molten resin with stirring. 80 parts of hot water at 95° C. was gradually added drop by drop to invert the mixture to an oil-in-water emulsion. Then, after 130 parts of hot water was added, the solution was rapidly cooled to 30° C. The resulting emulsion had a solid content of 32%.

The compositions, methods of emulsification, particle sizes and stability against resin sedimentation (a factor which affects the storage stability) of the aqueous dispersions obtained in Examples and Comparative Examples above are shown in Tables 1and 2. From the results given in Tables 1 and 2, it is evident that the size composition of the present invention is excellent in a storage stability.

TABLE 1

| | Rosin Compositions | | | | | | | |
|---|---|---|---|---|---|---|---|---|
| | | | | | Resin Composition | | | |
| | Resin Charge Ratio | | | | | | Unsaturated Carbonyl Compound wt % | |
| | Synthetic Resin | | Synthetic Resin | | Rosin TEA Ester | Rosin Gly Ester | | |
| Size | Parts | | Parts | | TEA wt % | Gly wt % | Manh | Fua |
| Example 1 | Synthesis Example 1 | 40 | Synthesis Example 2 | 60 | 4.5 | | 10.1 | |
| Example 2 | Synthesis Example 1 | 50 | Synthesis Example 2 | 50 | 5.6 | | 8.4 | |
| Example 3 | Synthesis Example 1 | 60 | Synthesis Example 2 | 40 | 6.6 | | 6.6 | |
| Example 4 | Synthesis Example 1 | 30 | Synthesis Example 2 | 30 | 3.2 | | 4.8 | |
| Example 5 | Synthesis Example 1 | 70 | Synthesis Example 2 | 30 | 7.7 | | 4.9 | |
| Comparative Example 1 | Synthesis Example 1 | 55 | Synthesis Example 2 | 45 | 6.1 | | 7.6 | |
| Comparative Example 2 | Synthesis Example 1 | 55 | Synthesis Example 2 | 45 | 6.1 | | 7.6 | |
| Comparative Example 3 | Synthesis Example 1 | 50 | Synthesis Example 2 | 50 | 5.0 | | 8.4 | |
| Comparative Example 4 | Comparative Synthesis Example 1 | | | | 6.0 | | 9.4 | |
| Comparative Example 5 | Comparative Synthesis Example 2 | | | | | 0 | 9 | |
| Comparative Example 6 | Synthesis Example 1 | | | | 10.0 | | | |
| Comparative Example 7 | Synthesis Example 1 | | | | | | 17.6 | |
| Comparative Example 8 | Comparative Synthesis Example 3 | | | | | | 6.4 | |
| Comparative | Comparative | | | | | | | 5.3 |

TABLE 1-continued

| | Rosin Compositions | | | | | |
|---|---|---|---|---|---|---|
| | | | Resin Composition | | | |
| | Resin Charge Ratio | | | | Unsaturated Carbonyl Compound wt % | |
| Size | Synthetic Resin Parts | Synthetic Resin Parts | Rosin TEA Ester TEA wt % | Rosin Gly Ester Gly wt % | Manh | Fua |
| Example 9 | Synthesis Example 4 | | | | | |

TABLE 2

| | Methods of Emulsification and Emulsion Properties | | | | | |
|---|---|---|---|---|---|---|
| | Emulsion Composition | | | | Average | |
| Size | | % | Casein Parts | Method of Emulsification | Particle Size μm | Storage Stability |
| Example 1 | MES-12 | 3.0 | 5 | Inversion method | 0.3 | Not exceeding 0.1% |
| Example 2 | MES-12 | 3.0 | 5 | Inversion method | 0.3 | Not exceeding 0.1% |
| Example 3 | A-103 | 3.0 | 4 | Inversion method | 0.4 | Not exceeding 0.1% |
| Example 4 | MES-12 | 1.5 | 4 | High pressure method | 0.3 | Not exceeding 0.1% |
| Example 5 | MES-12 | 3.0 | | High pressure method | 0.3 | Not exceeding 0.1% |
| Comparative Example 1 | A | 4.0 | 4 | Inversion method | 0.5 | 0.3% |
| Comparative Example 2 | B | 3.0 | 7 | Inversion method | 0.5 | 0.3% |
| Comparative Example 3 | | | 5 | Inversion method | 0.9 | 1.2% |
| Comparative Example 4 | | | 5 | Inversion method | 0.9 | 1.2% |
| Comparative Example 5 | C | 5 | | High pressure method | 0.4 | 0.2% |
| Comparative Example 6 | | | 4 | High pressure method | 0.5 | 0.3% |
| Comparative Example 7 | | | 5 | Inversion method | 0.4 | 0.5% |
| Comparative Example 8 | | | 5 | Inversion method | 0.5 | 0.4% |
| Comparative Example 9 | A | 5 | | Inversion method | 0.4 | 0.4% |

With respect to Tables 1 and 2, the resin composition is expressed in values relative to the starting material rosin (wt % for TEA=triethanolamine, equivalent ratio for esters, wt % for unsaturated carboxylic acids). Manh denotes maleic anhydride, and Fua denotes fumaric acid. Emulsion A is sulfate ester ammonium salt of polyoxyethylene nonylphenyl ether (10 mol of ethylene oxide was added). Emulsion B is sodium dodecylbenzenesulfonate. Emulsion C is sulfate ester ammonium salt of polyoxyethylene distyrylphenyl ether (12 mol of ethylene oxide was added). An average particle size was measured by using CAPA-500 (centrifugal sedimentation transmission type), produced by Horiba, Ltd. The storage stability was determined after 2 months of storage at 25° C. and indicated by as the amount of sedimentary resin in % ratio.

The size compositions obtained in Examples and Comparative Examples were evaluated as to sizing performance on the basis of Stoeckigt sizing degree (second). The results are given in Table 3. It is evident from Table 3 that the size composition of the present invention offers an excellent sizing in the neutral pH range centered at pH 7.

TABLE 3

| | Sizing Performance | | | |
|---|---|---|---|---|
| | Papermaking pH level | | | |
| Size | 6.0 | 6.5 | 7.0 | 7.5 |
| Example 1 | 22.6 | 18.6 | 17.6 | 16.7 |
| Example 2 | 22.5 | 18.7 | 17.3 | 16.9 |
| Example 3 | 22.0 | 18.0 | 16.6 | 15.6 |
| Example 4 | 22.0 | 18.5 | 16.9 | 16.0 |
| Example 5 | 22.5 | 18.4 | 17.2 | 16.6 |
| Comparative Example 1 | 19.8 | 16.0 | 14.7 | 13.8 |
| Comparative Example 2 | 20.3 | 16.6 | 14.5 | 13.9 |
| Comparative Example 3 | 18.5 | 15.9 | 13.8 | 10.5 |
| Comparative Example 4 | 19.0 | 16.2 | 13.9 | 10.5 |
| Comparative Example 5 | 17.8 | 14.2 | 11.6 | 7.6 |
| Comparative Example 6 | 7.5 | 3.3 | 1.0 | Not exceeding 1 |
| Comparative Example 7 | 4.7 | 1.0 | Not exceeding 1 | Not exceeding 1 |
| Comparative Example 8 | 14.8 | 10.5 | 6.8 | 1.6 |
| Comparative Example 9 | 16.9 | 6.3 | 1.2 | Not exceeding 1 |

Sizing performance was tested by using 420 ml of the L/NBKP (L/N=8/2) CSF pulp. A given amount of calcium carbonate was added to 2.5% slurry of this pulp. With stirring, cationic starch was added. Two minutes later, the size was added. Thirty seconds later, alminium sulfate was added. Thirty seconds later, a polyacrylamide-based retention aid was added. Thirty seconds later, hand-made paper (66 to 70 g/m$^2$) was prepared by the ordinary method of using a hand papermaking tester. The resulting hand-made paper was kept standing in a chamber at a constant temperature and constant humidity maintained at 20° C. and 65% humidity for 1 day and then subjected to a sizing test.

The addition ratio of cationic starch was 0.5 wt % of the absolute dry pulp weight. The addition ratio of size was 0.4 wt % of the absolute dry pulp weight for papermaking pH levels of 6.0, 6.5 and 7.0 and 0.6 wt % for a papermaking pH level of 7.5. The addition ratio of retention aid was 0.02 wt % of the absolute dry pulp weight.

The papermaking pH was adjusted so that calcium carbonate and aluminum salfate were contained in the following ratios.

pH 6.0: 1 wt % calcium carbonate and 1 wt % aluminium sulfate to pulp pH 6.5: 2 wt % calcium carbonate and 1 wt % aluminium sulfate to pulp pH 7.0: 10 wt % calcium carbonate and 1 wt % aluminium sulfate to pulp pH 7.5: 10 wt % calcium carbonate and 0.5 wt % aluminium sulfate to pulp The size composition for papermaking of the present invention shows an excellent sizing effect in the papermaking pH range above 6.5, and makes a great contribution to the production of neutral paper of good durability and good storage stability.

The various examples given above are to illustrate the size composition for papermaking of the present invention and are not to be interpreted as limitative on the invention.

What is claimed is:

1. A rosin-containing size composition containing a solids content of 10–60%, the composition comprising a surfactant represented by formula (1) shown below in a ratio of 1 to 10 wt % of the solids content of the size composition and casein in a ratio not exceeding 10 wt % of the solids content of the size composition dispersed in a mixture of an esterification product of a rosin and an alkanol tertiary amine which is produced by adding the alkanol tertiary amine in a ratio of 1.5 to 10 wt % of the total rosin content in the size composition, and (b) a fortified rosin produced by adding an α, β-unsaturated carbonyl compound in a ratio of 3 to 11 wt % of the total rosin content in the size composition, to give a solids content of 10 to 60 wt % in the size composition;

$$R-O(CH_2CH_2O)_nOC-\underset{X}{\underset{|}{CH}}-\underset{Y}{\underset{|}{CH}}-COOM \quad (1)$$

wherein in the above formula (1), R represents a $C_{10-24}$ alkylphenyl group or a linear or branched alkyl group; n represents an integer of 6 to 20; X and Y independently represent H or $SO_3M$; and M represents sodium, potassium or an ammonium group.

2. The size composition of claim 1 wherein said rosin is selected from the group consisting of gum rosin, tall oil rosin and wood rosin.

3. The size composition of claim 1 wherein the alkanol tertiary amine is selected from the group consisting of triethanolamine, tri-n-propanolamine, triisopropanolamine, N-isobutyldiethanolamine and N-normal-butyldiethanolamine.

4. The size composition of claim 1 wherein the esterification of the rosin and the alkanol tertiary amine is carried out by thermally melting the rosin and then adding the alkanol tertiary amine thereto drop by drop.

5. The size composition of claim 4 wherein the esterification of the rosin and the alkanol tertiary amine is carried out in the temperature range from 190° to 230° C.

6. The size composition of claim 1 wherein the α, β-unsaturated carbonyl compound which is used to form the fortified rosin is selected from the group consisting of maleic acid, maleic anhydride, fumaric acid, itaconic acid, itaconic anhydride, citraconic acid, acrylic acid and methacrylic acid.

7. The size composition of claim 1 wherein said surfactant is obtained by condensing an alkyl phenol, an alcohol or an ethylene oxide, and converting the resulting condensate to a sulfosuccinic acid halfester salt.

* * * * *